US008845464B1

(12) United States Patent
Hyde

(10) Patent No.: US 8,845,464 B1
(45) Date of Patent: Sep. 30, 2014

(54) METHOD FOR REDUCING THE SIZE OF A GROUPING PATTERN FOR A SET OF MULTIPLE BOLTS SHOT BY A CROSSBOW

(75) Inventor: Tony E. Hyde, Monroe, OR (US)

(73) Assignee: BowTech, Inc., Eugene, OR (US)

( * ) Notice: Subject to any disclaimer, the term of this patent is extended or adjusted under 35 U.S.C. 154(b) by 0 days.

(21) Appl. No.: 13/587,924

(22) Filed: Aug. 17, 2012

(51) Int. Cl.
*F42B 6/06* (2006.01)

(52) U.S. Cl.
CPC ..... *F42B 6/06* (2013.01)
USPC ..... 473/586; 473/578

(58) Field of Classification Search
USPC ..... 473/578, 585, 586
See application file for complete search history.

(56) References Cited

U.S. PATENT DOCUMENTS

| | | | | | |
|---|---|---|---|---|---|
| 4,544,163 | A * | 10/1985 | Scanlon | ..... | 473/578 |
| 5,154,432 | A * | 10/1992 | Saunders | ..... | 473/578 |
| 5,186,470 | A * | 2/1993 | Easton et al. | ..... | 473/578 |
| 6,203,457 | B1 * | 3/2001 | Snook | ..... | 473/586 |
| 2013/0116071 | A1 * | 5/2013 | Bednar et al. | ..... | 473/578 |

* cited by examiner

*Primary Examiner* — John Ricci
(74) *Attorney, Agent, or Firm* — David S. Alavi

(57) ABSTRACT

Each bolt of a set has three vanes and a nock with three diametrical transverse grooves; each groove is perpendicular to a corresponding vane. Each bolt is shot at least three times with a crossbow, at least once with each one of the vanes extending downward into the rail slot of a crossbow. After noting the positions on a target for each shot of each bolt, one vane of each bolt is marked so that shooting the set of bolts with the corresponding marked vanes extending downward into the rail slot results in the smallest grouping pattern for the set of bolts.

1 Claim, 12 Drawing Sheets

METHOD FOR REDUCING THE SIZE OF A GROUPING PATTERN FOR A SET OF MULTIPLE BOLTS SHOT BY A CROSSBOW

BACKGROUND

The field of the present invention relates to archery equipment. In particular, a nock for an arrow or bolt is described herein that permits multiple relative orientations of a nocked arrow or bolt and a bowstring.

A conventional arrow or bolt includes a single transverse notch or groove 86 (the nock; a conventional nock member 85 is shown in FIG. 1) on the rearward end of its shaft for receiving the bowstring of a bow or crossbow. The term "bolt" typically refers to a relatively shorter, heavier arrow used in a crossbow; "arrow" and "bolt" shall be considered interchangeable for purposes of the present disclosure or appended claims. The single groove 86 of a conventional nock member 85 allows the arrow or bolt to be fitted to the bowstring in one of only two relative orientations; typically, only one of those two relative orientations is the correct one (discussed further below).

The most common arrangement of the fletching of an arrow or bolt 80 includes three longitudinal vanes 88*a*, 88*b*, and 88*c* (collectively, vanes or fletching 88*x*; FIGS. 2-4). The vanes 88*x* are each attached to a rearward portion of a circumferential surface of the shaft 82 along corresponding substantially longitudinal lines of attachment and extend transversely from the shaft 82. The corresponding lines of attachment are separated from one another by angles of about 120° about the longitudinal axis of the shaft 82. The single groove 86 of the conventional nock is arranged to be substantially perpendicular to a diameter of the shaft that coincides with the line of attachment of one of the three vanes 88*x* (as in FIG. 2). That vane is referred to as the "cock" vane 88*a*; the other two vanes are referred to as the "hen" vanes 88*b* and 88*c*.

When, in preparation for shooting the arrow 80, a conventional, single-nock arrow 80 is fitted onto the bowstring 99 (i.e., "nocked") of a vertical archery bow (i.e., a bow that is not a crossbow), the correct relative orientation of the arrow and bowstring is typically chosen so that the cock vane 88*a* points away from the bow riser 92 and the hen vanes 88*b* and 88*c* are on the side of the arrow closer to the bow riser 92 (as in FIG. 3). That arrangement reduces interference (relative to the other relative orientation wherein the cock vane 88*a* points toward the bow riser 92) between the fletching 88 and the bow riser 92 as the arrow 80 is launched past the bow riser 92 upon releasing the drawn bowstring 99.

When a conventional, single-nock bolt 80 is loaded into a crossbow, it typically rests on a longitudinal rail 94 (as in FIG. 4). The rail 94 has a midline slot; the bolt 80 typically is placed on the rail 94 with the cock vane 88*a* extending downward into the slot, which results in the nock groove 86 being oriented substantially horizontally, substantially aligned with and parallel to the bowstring 99 of the crossbow. If instead one of the hen vanes 88*b* or 88*c* is placed in the midline slot of the rail 94, however, the nock groove 86 and the bowstring 99 are not properly aligned, instead forming about a 60° angle with respect to one another (not shown). That misalignment of the nock groove 86 and bowstring 99 can lead to a range of undesirable consequences, including one or more of the following. The lack of proper engagement of the bowstring 99 with the nock groove 86 can lead to inaccurate movement of the bolt 80 along the rail 94 and an inconsistent or unpredictable flight path of the bolt 80. The bowstring 99 can lose contact with the nock altogether, leading to a misfire of the crossbow and potentially damaging the bolt 80 or crossbow or injuring the archer. In certain instances, e.g., if the bolt 80 has a so-called "half-moon" nock with somewhat sharp edges (as in FIG. 1), the misaligned nock can sever the bowstring 99 when the crossbow is fired, destroying the bowstring 99 and potentially damaging the crossbow severely or injuring the archer.

SUMMARY

An arrow or bolt comprises a shaft, fletching, and a nock member. The fletching comprises three or more longitudinal vanes that (i) are attached to a rearward portion of a circumferential surface of the shaft along corresponding substantially longitudinal lines of attachment, (ii) extend transversely from the shaft, and (iii) are arranged substantially symmetrically about a longitudinal axis of the shaft. The nock member is attached to a rear end of the shaft. The nock member comprises generally cylindrical forward and rearward segments that are substantially concentric with the longitudinal axis, and the forward segment has a radius smaller than a radius of the rearward segment. The forward segment is sized and arranged to be received within and retained by a hollow rear end of the shaft; the rearward segment is sized so as to prevent entry of the rearward segment into the hollow rear end of the shaft. A rear surface of the rearward segment includes two or more substantially diametrical transverse grooves that are (i) sized to receive a bowstring of a bow or crossbow and (ii) arranged substantially symmetrically about the longitudinal axis. Each one of the two or more grooves is substantially perpendicular to a diameter of the shaft that coincides with at least one line of attachment of a corresponding vane of the fletching. A method for making the arrow or bolt comprises attaching the nock member to the rear end of the shaft, and can further comprise attaching the fletching to the shaft.

Objects and advantages pertaining to a nock for a bolt or arrow may become apparent upon referring to the exemplary embodiments illustrated in the drawings and disclosed in the following written description or appended claims.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

It should be noted that the embodiments depicted in this disclosure are shown only schematically, and that not all features may be shown in full detail or in proper proportion. Certain features or structures may be exaggerated relative to others for clarity. It should be noted further that the embodiments shown are exemplary only, and should not be construed as limiting the scope of the written description or appended claims.

DETAILED DESCRIPTION OF EMBODIMENTS

It is desirable to provide a nock member for a bolt or arrow that mitigates or eliminates the problems described above for a bolt or arrow with a conventional, single-groove nock. In particular, it is desirable to provide a nock member that permits a bolt to be placed on the rail of a crossbow with any one of the vanes inserted into the slot of the rail while permitting proper alignment of a nock groove with the bowstring of the crossbow.

Figure 1:
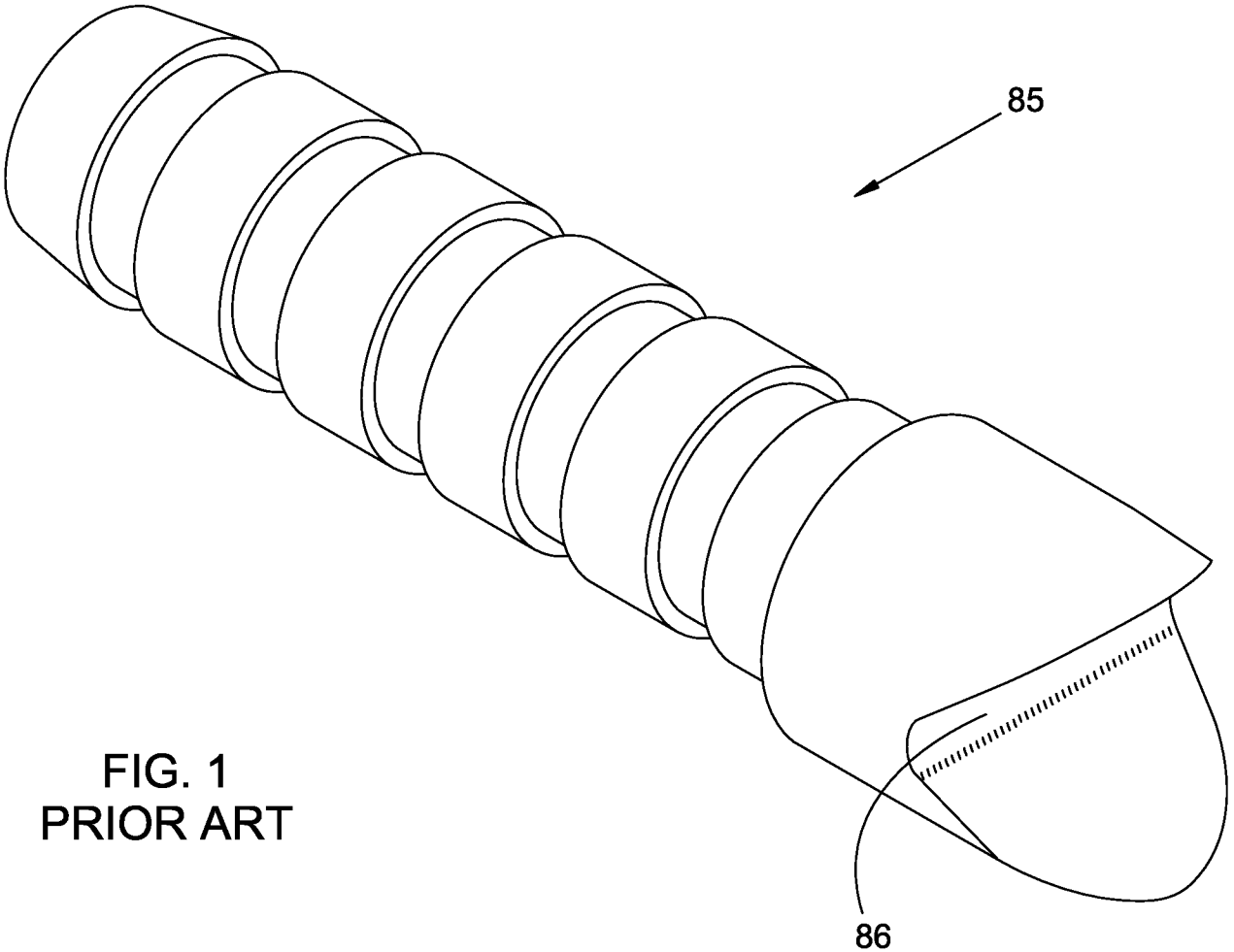
FIG. 1 PRIOR ART
FIG. 1 is a perspective view of a nock member of a conventional arrow or bolt.
Figure 2:
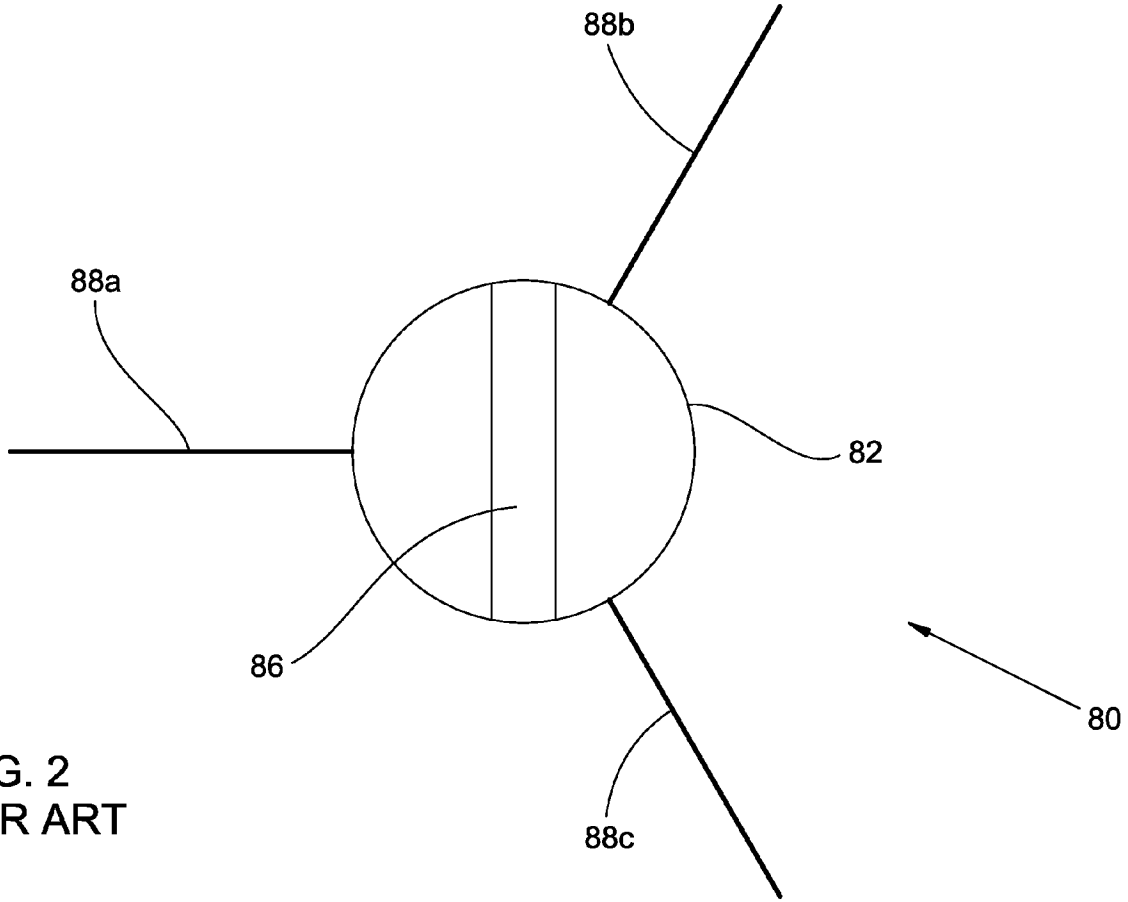
FIG. 2 PRIOR ART
FIG. 2 is a rear view of a conventional arrow or bolt.
Figure 3:
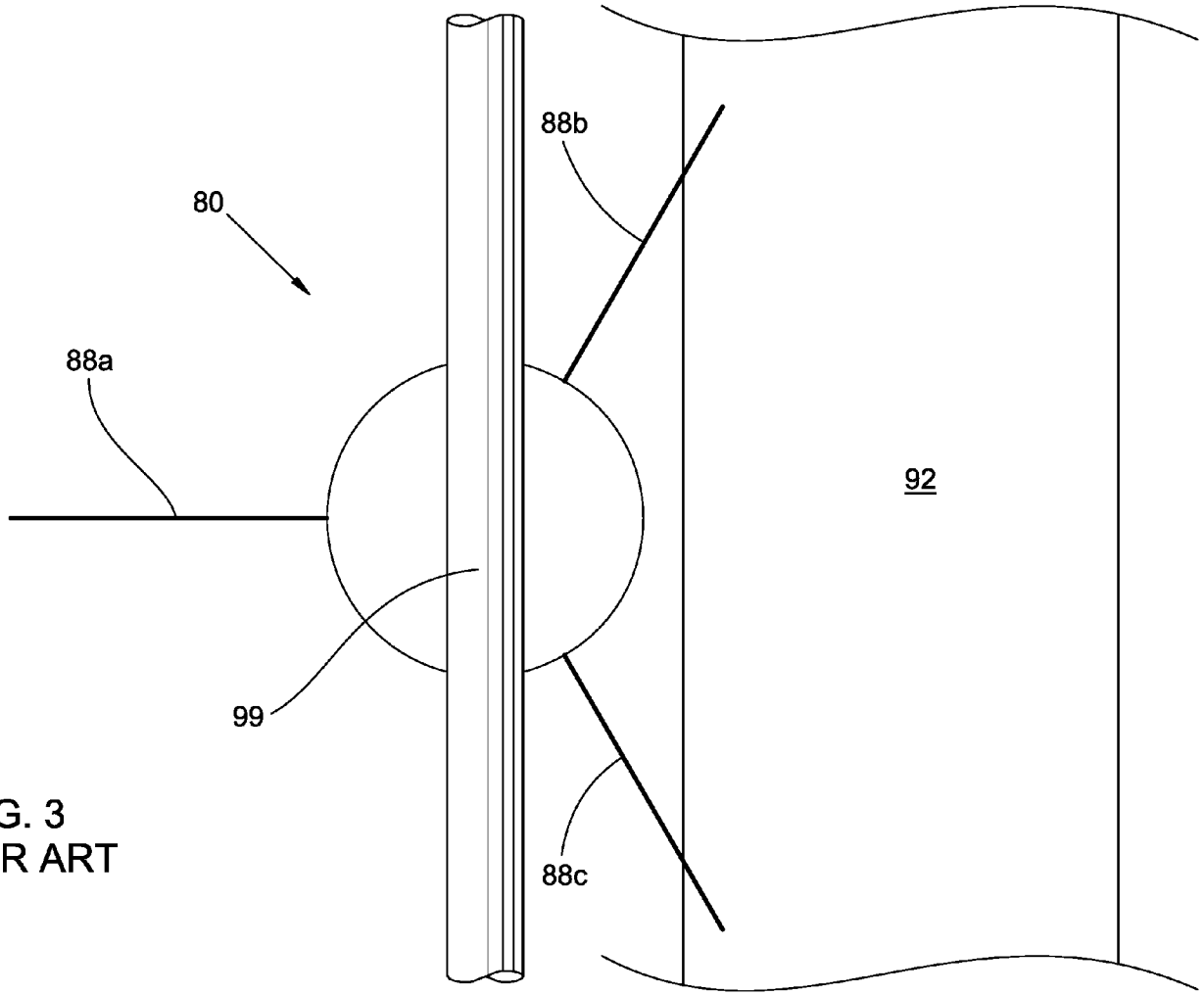
FIG. 3 PRIOR ART
FIG. 3 is a rear view of a conventional arrow or bolt nocked onto the bowstring of a vertical archery bow.
Figure 4:
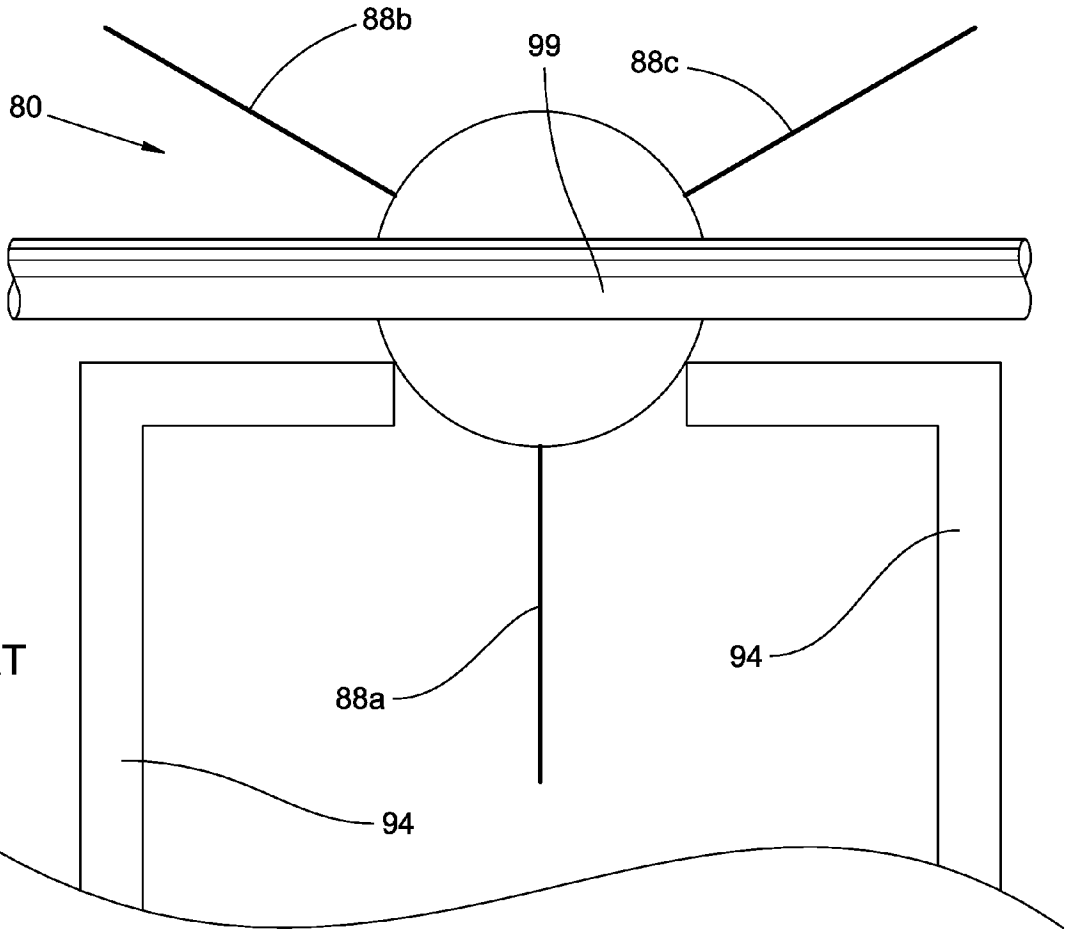
FIG. 4 PRIOR ART
FIG. 4 is a rear view of a conventional arrow or bolt loaded onto the rail of a crossbow.
Figure 5:
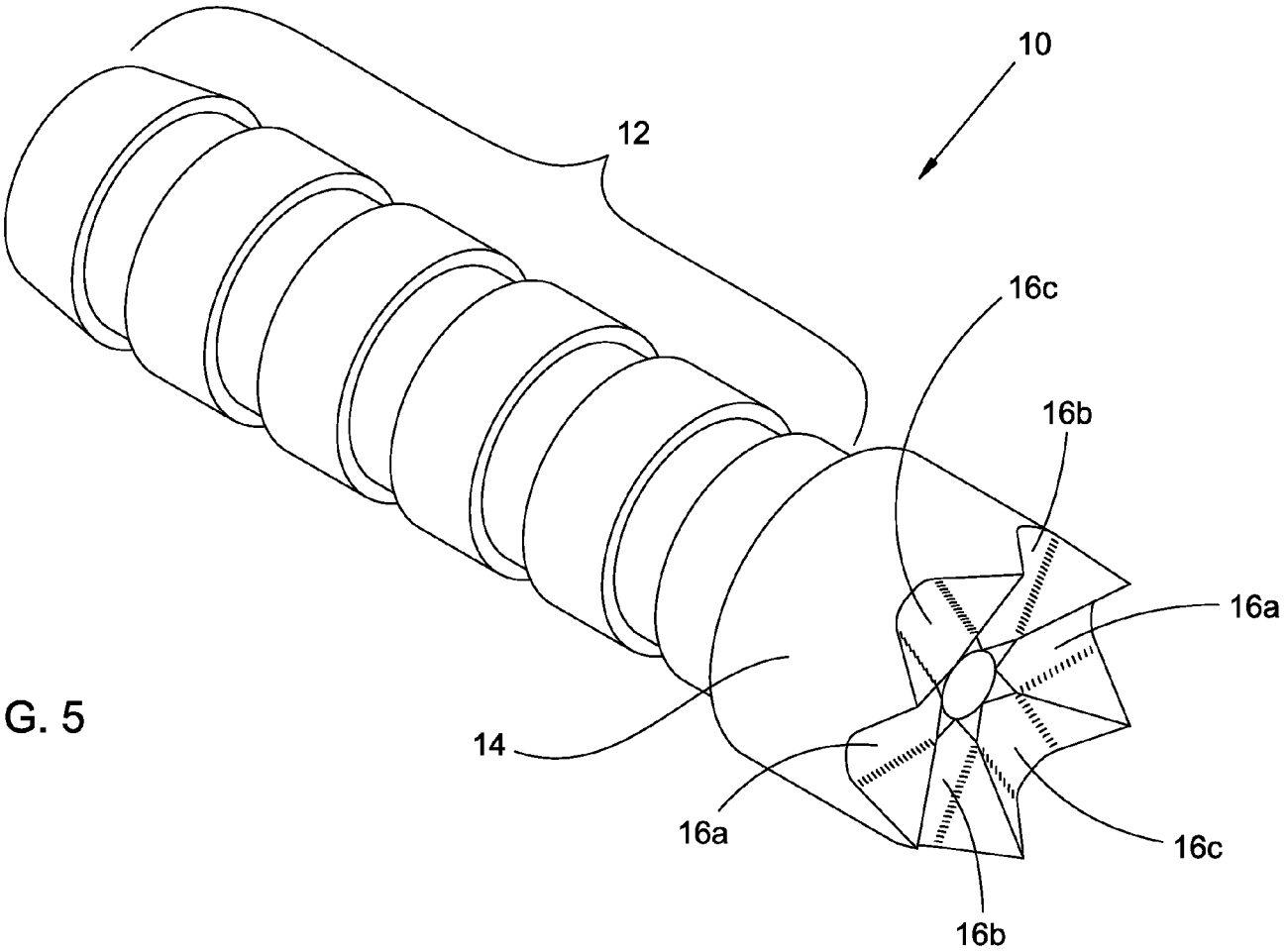
FIG. 5 is a perspective view of a nock member according to the present disclosure.
Figure 6B:
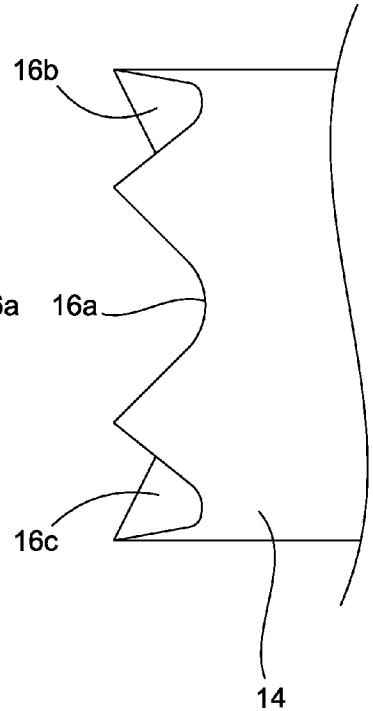
FIGS. 6A-6C are a rear and two side views, respectively, of a rearward segment of a nock member according to the present disclosure.
Figure 6A:
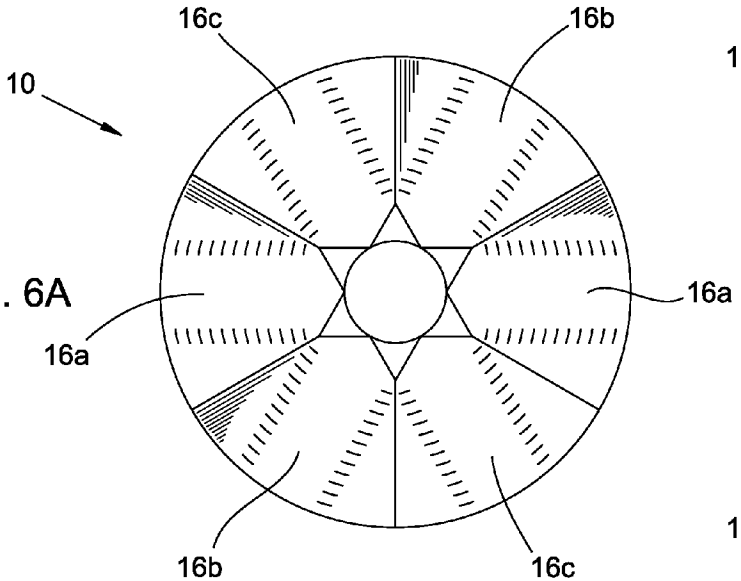
Figure 6C:
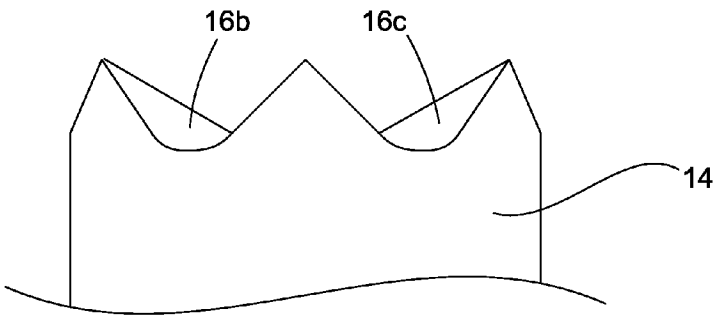
Figure 7:
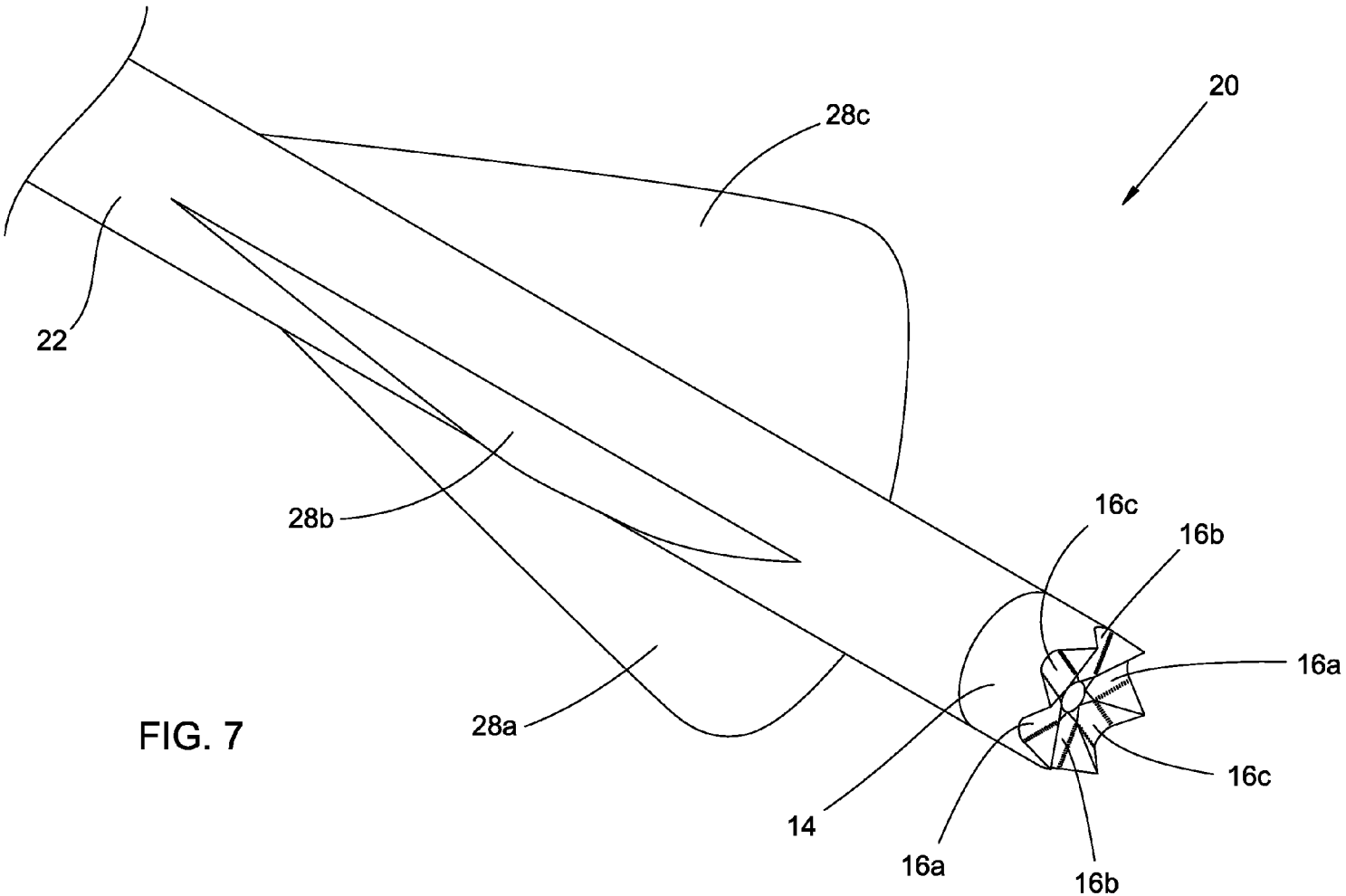
FIGS. 7 and 8 are perspective and rear views, respectively, of a bolt or arrow according to the present disclosure.
Figure 8:
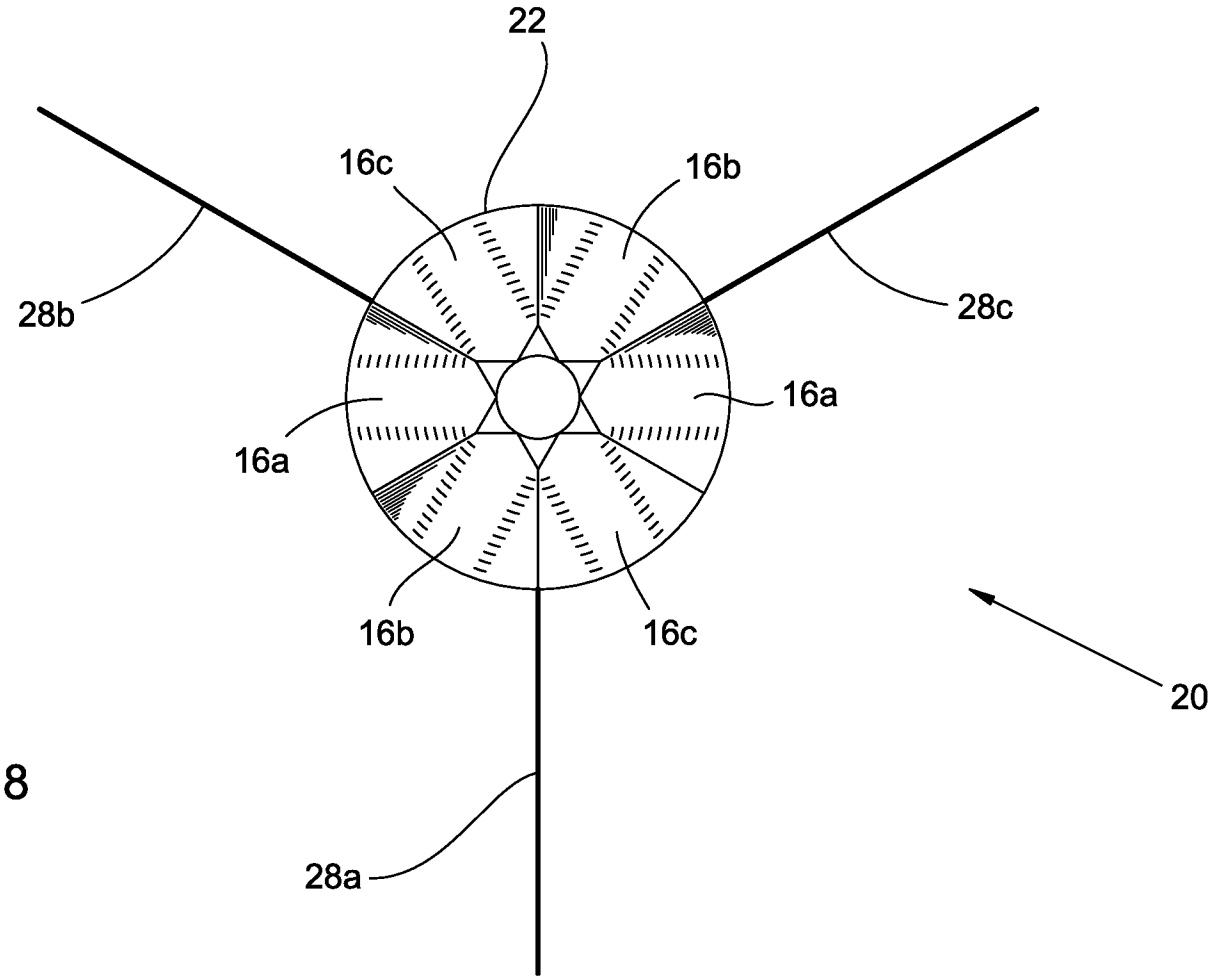
Figure 10:
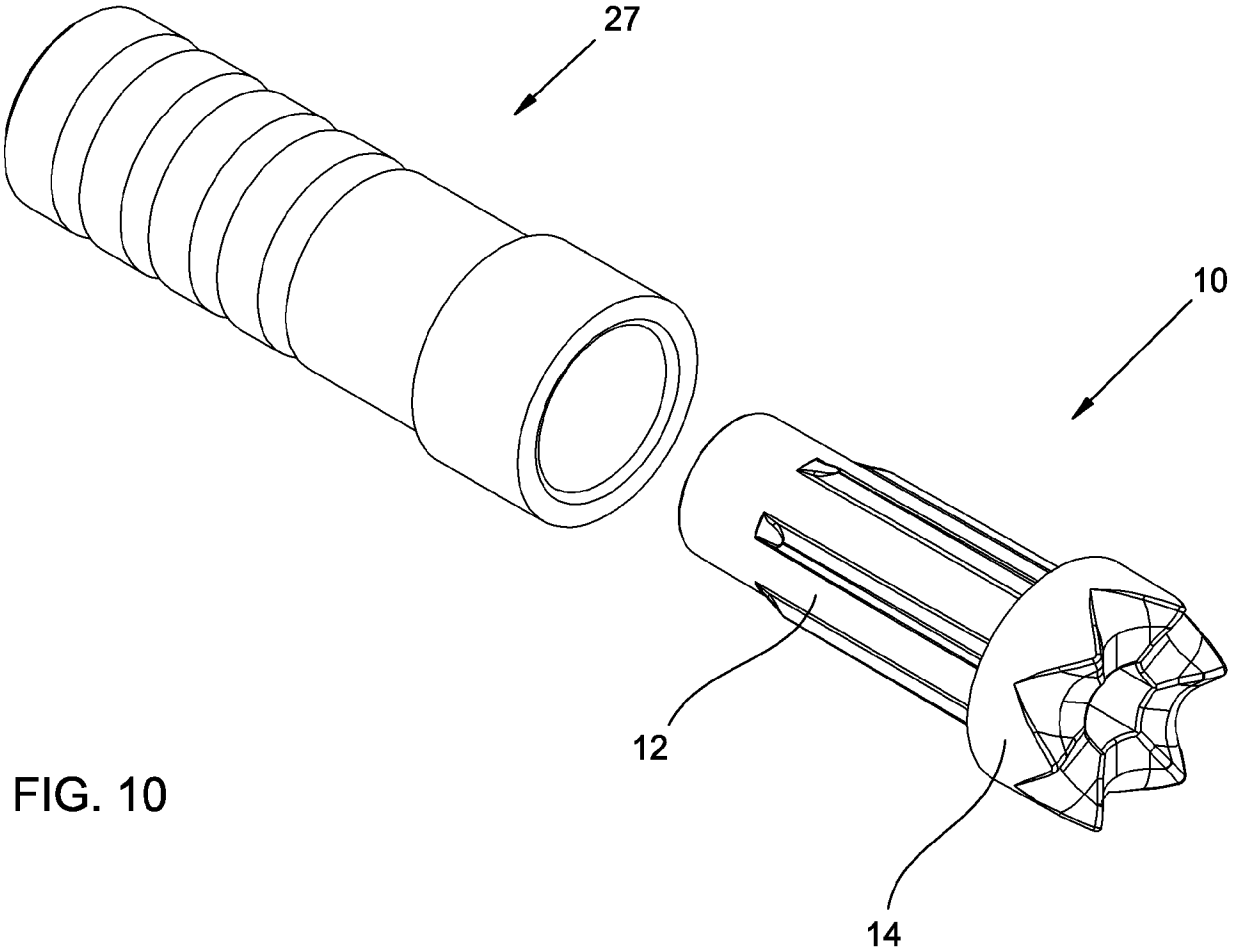
FIG. 10 is a perspective view of a nock member according to the present disclosure and a metal insert for the rearward end of an arrow shaft.

A nock member 10 is shown in FIGS. 5 and 6A-6C and comprises generally cylindrical and substantially concentric forward and rearward segments 12 and 14, respectively. The radius of forward segment 12 is smaller than the radius of rearward segment 14. The forward segment 12 is sized and arranged to be received within and retained by a hollow rear end of a shaft 22 of the arrow or bolt 20 (which also includes a tip 24 and fletching 28; FIGS. 7 and 8). In the exemplary embodiment shown in FIG. 5, the forward segment 12 includes circumferential ridges and grooves for retaining the nock member 10 in the hollow rear end of the shaft 22. In the exemplary embodiment of FIG. 10, the forward segment 12 includes longitudinal ridges for retaining the nock member 10 in the hollow rear end of the shaft 22 in a press-fit arrangement; in this example the hollow rear end of the shaft 22 is shown comprising an insert 27. Any other suitable arrangement or adaptation can be employed within the scope of the present disclosure or appended claims for attaching the nock member 10 to the rear end of the shaft 22. The rearward segment 14 is sized so as to prevent entry of the rearward segment 14 into the hollow rear end of the shaft 22. Typically a circumferential ledge or shoulder divides the forward segment 12 from the rearward segment 14, and the rear end of the shaft 22 is positioned against that ledge or shoulder when the nock member is attached to the shaft 22. Any other suitable arrangement for enabling entry of the forward segment 12 into the shaft 22 while preventing entry of the rearward segment 14 into the shaft 22 can be employed while remaining within the scope of the present disclosure or appended claims.

A rear surface of the rearward segment 14 includes two or more substantially diametrical transverse grooves 16 that are (i) sized to receive a bowstring 99 of a bow or crossbow and (ii) arranged substantially symmetrically about a longitudinal axis of the nock member 10. In the example shown in the drawings, the nock member 10 includes exactly three grooves 16*a*, 16*b*, and 16*c* (collectively, grooves 16). The three grooves 16 are separated from one another by angles of about 60° about the longitudinal axis. The nock member is shown attached to the arrow or bolt 20 in FIGS. 7 and 8. The fletching 28 of the arrow or bolt 20 includes three longitudinal vanes 28*a*, 28*b*, and 28*c* (collectively, vanes or fletching 28). The vanes 28 are each attached to a rearward portion of a circumferential surface of the shaft 22 along corresponding substantially longitudinal lines of attachment and extend transversely from the shaft 22. The corresponding lines of attachment are separated from one another by angles of about 120° about the longitudinal axis of the shaft 22.

Each one of the grooves 26 is substantially perpendicular to a diameter of the shaft 22 that coincides with at least one line of attachment of a corresponding vane of the fletching 28. In the example shown in the drawings, the groove 16*a* is substantially perpendicular to a shaft diameter coinciding with the vane 28*a*, the groove 16*b* is substantially perpendicular to a shaft diameter coinciding with the vane 28*b*, and the groove 16*c* is substantially perpendicular to a shaft diameter coinciding with the vane 28*c*. The arrangement of FIGS. 7 and 8 eliminates the distinction between a cock vanes and hen vanes; instead, each one of the transverse grooves 16 or the nock member 10 is substantially perpendicular to a diameter of the shaft that substantially coincides with a line of attachment of a corresponding one of the three vanes 28.

In another example (not shown), an arrow or bolt can include fletching comprising four vanes arranged on the shaft about 90° apart and two nock grooves about 90° apart, with each nock groove being substantially perpendicular to a corresponding diameter coinciding with two opposing vanes of the fletching. Any suitable or desired number of multiple transverse grooves 16 and multiple vanes 28 can be employed.

Figure 9A:
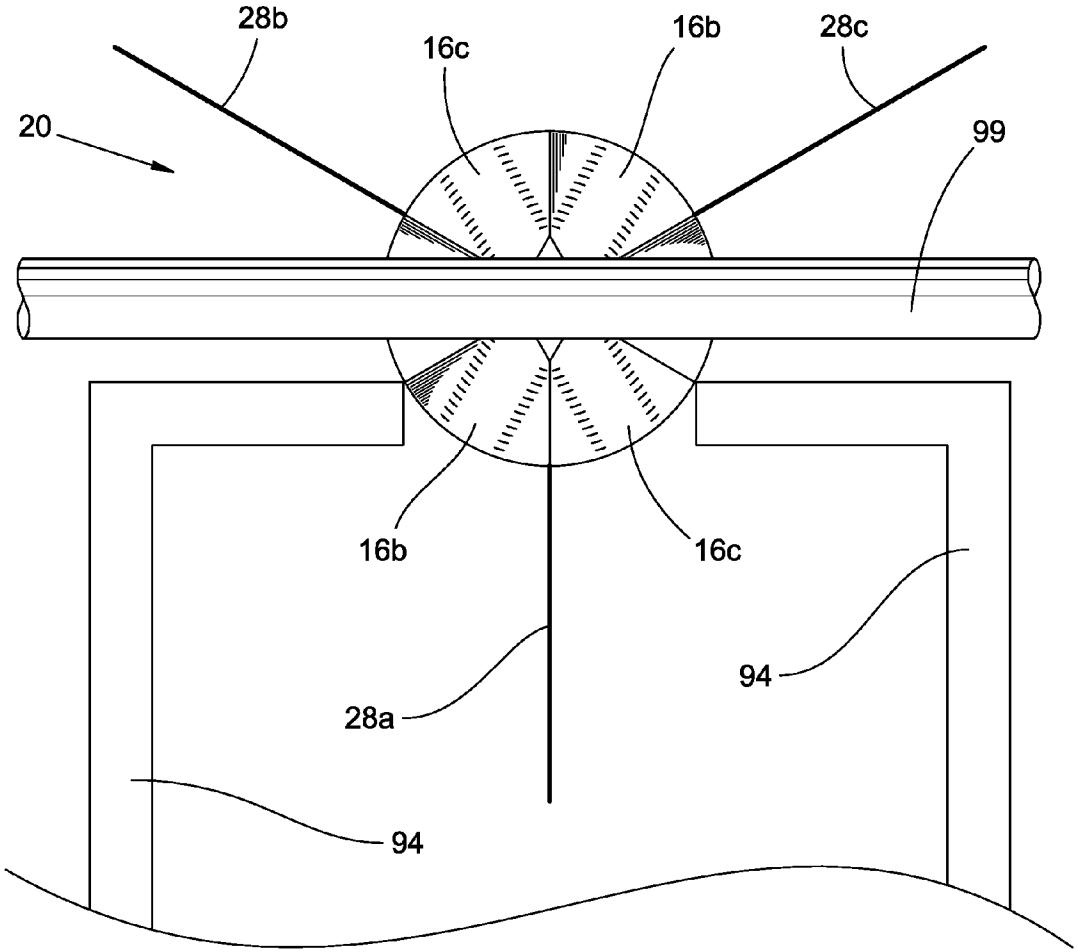
FIGS. 9A-9C are rear views of an arrow or bolt according to the present disclosure loaded onto the rail of a crossbow in three different relative orientations.
Figure 9B:
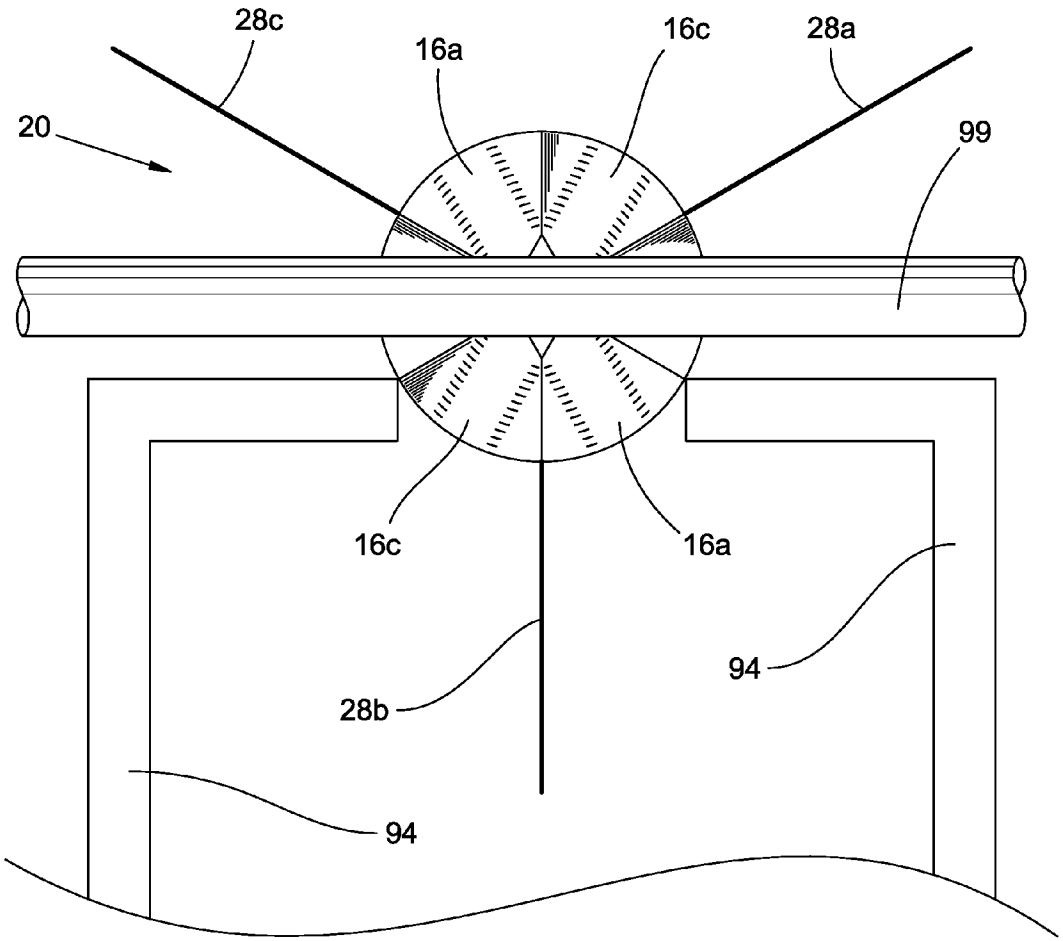
Figure 9C:
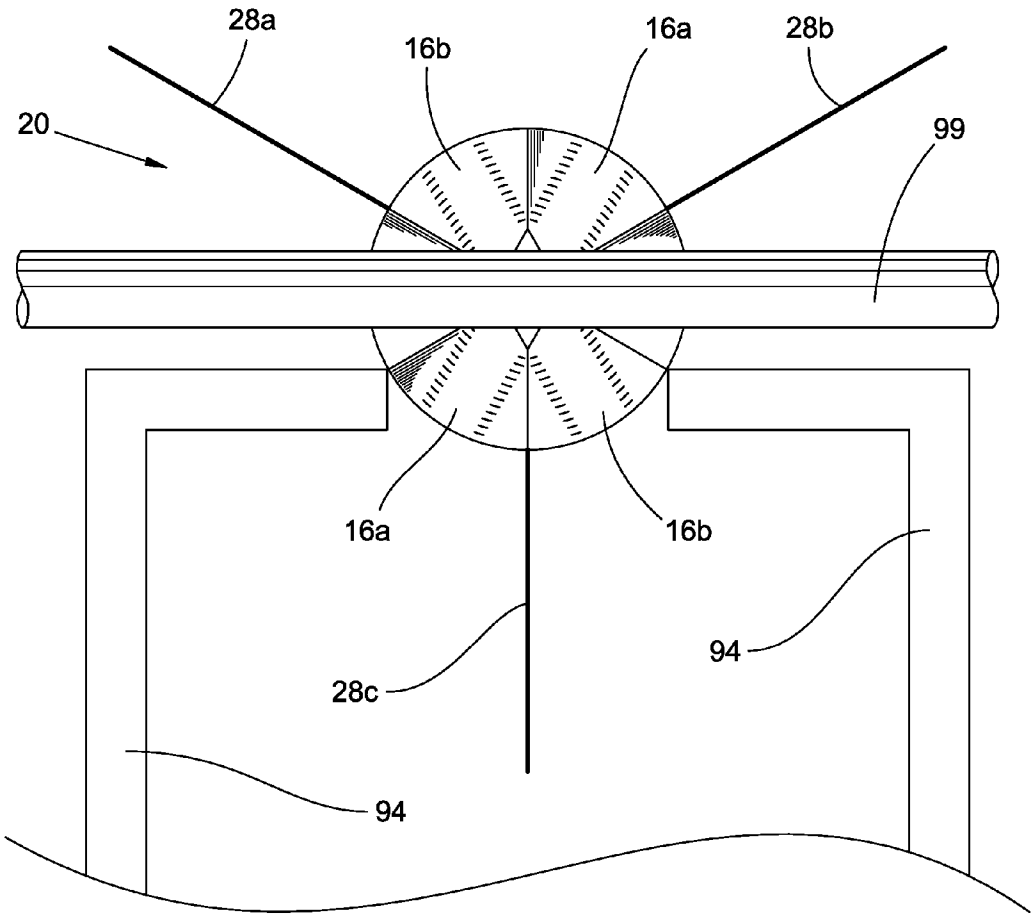

FIGS. 9A-9C illustrate one benefit of the arrangement of FIGS. 7 and 8. The arrow of bolt 20 can be loaded onto the rail 94 of the crossbow with any one of the three vanes 28 extending downward into the midline slot of the rail 94 while still enabling the bowstring 99 to align with a corresponding one of the transverse slots 16. In FIG. 9A, vane 28*a* extends downward into the midline slot of the rail 94 and the transverse nock groove 16*a* aligns with the bowstring 99; in FIG. 9B, vane 28*b* extends downward into the midline slot of the rail 94 and the transverse nock groove 16*b* aligns with the bowstring 99; In FIG. 9C, vane 28*c* extends downward into the midline slot of the rail 94 and the transverse nock groove 16*c* aligns with the bowstring 99. The problems described above resulting from misalignment of the nock groove and the bowstring are thus eliminated.

A further advantage is provided by the arrangement of FIGS. 7 and 8. With a conventional single nock groove on a bolt, the archer is forced to always insert the same vane into the rail slot. However, with the ability to insert any one of the three vanes 28 into the rail slot, it has been observed that the flight of a given bolt varies depending on which vane is inserted into the rail slot. As noted in the preceding paragraph, the archer no longer needs to ensure that the correct vane is inserted into the midline slot of the crossbow rail to avoid inaccurate flight, misfire, damage, or injury. With the bolt arrangement of FIGS. 7 and 8, however, the archer can choose which one of the three vanes to insert into the slot when loading the bolt onto the crossbow rail. In a process somewhat analogous to alignment or "sighting in" of the bow using a target, all three bolt orientations can be tried and one orientation selected for each bolt of a set that results in the tightest "grouping" of that set of bolts on the target when they are shot. The selected vane of each bolt of the set can be marked for future reference (in effect, becoming the de facto cock vane), so that the archer can always choose to place that vane into the crossbow rail slot to achieve more consistent aiming of a set of multiple bolts. Such optimization of a set of bolts is not possible when the same vane of each bolt must always go into the rail slot, as is the case for conventional bolts having only a single transverse nock groove.

The nock member 10 can comprise any suitable, sufficiently rigid material. Nock member 10 is often fabricated from metal or plastic. Aluminum, magnesium, and titanium are examples of suitable, lightweight metals; other metals can be employed. Nickel-plated metal may be desirable for impeding wear, particularly for a bolt 20 used with a crossbow, where the nock member 10 rubs along the metal rail 94 of the crossbow when the bolt 20 is shot; electroless nickel plating may be particularly desirable. Plastics must be sufficiently rigid and strong to withstand the high forces generated when the bolt 20 is shot. Glass-filled nylon and polycarbonate are examples of suitable plastic materials. Metal-coated plastic can be employed (coated with any suitable metal by plating, deposition, or other suitable process; nickel is one example of a suitable metal for coating a plastic nock member). If plastic is employed, it may be desirable to employ a metal insert 27 (FIG. 10) in the rear end of the shaft 22, to protect the remainder of the shaft 22 in the event of breakage of the plastic nock member 10. The nock member 10 can be fabricated by machining, molding, or any other process suitable for forming the desired structural features. In some instances molding may be preferred because the resulting molded edges tend to be somewhat rounded or blunted, whereas extra machining steps may be required to round or blunt sharper machined edges.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

In the foregoing Detailed Description, various features may be grouped together in several exemplary embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed exemplary embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., sets of features that are not incompatible or mutually exclusive) that appear in the present disclosure or the appended claims, including those sets that may not be explicitly disclosed herein. It should be further noted that the scope of the appended claims do not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof, wherever they appear, shall be construed as open ended terminology, with the same meaning as if the phrase "at least" were appended after each instance thereof.

In the appended claims, if the provisions of 35 USC §112 ¶6 are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112 ¶6 are not intended to be invoked for that claim.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A method comprising:

(a) using a crossbow and a target, taking at least three shots at the target with the crossbow and a first bolt of a set of multiple bolts, wherein, for each one of three vanes of fletching on the first bolt, at least one of the shots is taken with that corresponding vane extending downward into a rail slot of the crossbow when the first bolt is loaded onto the crossbow;

(b) repeating step (a) for each additional bolt of the set of multiple bolts;

(c) for each shot taken in steps (a) and (b), noting a corresponding position of each bolt on the target and the corresponding vane that was in the crossbow rail slot; and (d) for each bolt of the set, selecting and marking only one of the three vanes, wherein the vane selected for each bolt results in a grouping of the corresponding positions on the target of the bolts of the set, which grouping is smaller than any other grouping of the positions of the set of bolts on the target, wherein each bolt includes:

(i) the fletching having exactly three of the vanes with corresponding lines of attachment to a shaft of the bolt that are separated from one another by angles of about 120° about a longitudinal axis of the bolt; and (ii) a nock member attached to a rear end of the shaft with a rearward surface that includes exactly three grooves that are separated from one another by angles of about 60° about the longitudinal axis, (iii) wherein each one of the grooves is substantially perpendicular to a diameter of the shaft that coincides with the line of attachment of one corresponding vane of the fletching.

* * * * *